US005288046A

United States Patent [19]

Eklof et al.

[11] Patent Number: 5,288,046

[45] Date of Patent: Feb. 22, 1994

[54] UNIVERSAL SHELF EXTENDER

[75] Inventors: Thomas E. Eklof; Walter M. Poterbin; Roger L. Fernandez, all of Santa Cruz County, Calif.

[73] Assignee: Santa Cruz Industries, Santa Cruz, Calif.

[21] Appl. No.: 774,042

[22] Filed: Oct. 7, 1991

[51] Int. Cl.[5] ..... A47F 5/00

[52] U.S. Cl. ..... 248/220.2; 248/223.4; 248/222.2; 248/225.1; 211/126; 211/88

[58] Field of Search ..... 248/220.2, 222.2, 206.3, 248/223.4, 224.1, 224.2, 231.2, 225.1; 211/88, 126

[56] References Cited

U.S. PATENT DOCUMENTS

| | | | |
|---|---|---|---|
| 2,636,633 | 4/1953 | Carlson | 211/88 X |
| 2,771,263 | 11/1956 | Boho | 248/223.4 X |
| 2,979,120 | 4/1961 | Amburn | 211/88 X |
| 3,015,897 | 1/1962 | Hopp | 248/231.2 X |
| 3,189,187 | 6/1965 | Gayer, Jr. et al. | 248/231.2 X |
| 3,659,722 | 5/1972 | Carroll | 211/106 |
| 3,813,813 | 6/1974 | Powell | 211/88 X |
| 3,949,880 | 4/1976 | Fortunato | 211/126 X |
| 4,234,094 | 11/1980 | Jorgensen | 211/88 |
| 4,340,144 | 7/1982 | Cousins | 248/222.2 X |
| 4,730,740 | 3/1988 | Winter et al. | 211/189 |
| 4,828,121 | 5/1989 | Wilcocks, Jr. | 211/126 X |
| 4,884,702 | 12/1989 | Rekow | 211/90 |
| 4,890,747 | 1/1990 | Sayers | 211/106 |

FOREIGN PATENT DOCUMENTS

| | | | |
|---|---|---|---|
| 495490 | 11/1938 | United Kingdom | 211/126 |
| 1181706 | 2/1976 | United Kingdom | 248/206.3 |

OTHER PUBLICATIONS

McCormick/Schilling Spec Sheets (10 pages).

*Primary Examiner*—Alvin C. Chin-shue

*Attorney, Agent, or Firm*—Flehr, Hohbach, Test, Albritton & Herbert

[57] ABSTRACT

A shelf extender for use in displaying articles from foil trees, display stands or other shelving in supermarkets and stores. A tray is formed on its back wall with projections having grooves adapted to releasably engage the vertical rods of a foil tree. The back side of the tray is also formed with a pocket which releasably holds different brackets which are adapted for various mounting configurations. In one configuration the bracket is comprised of an expandable C-shaped clamp for attachment to a tag strip. In another configuration the bracket is comprised of a C-clamp for mounting the tray on the edge of a shelf. In another configuration the bracket is comprised of hooks for mounting the tray to a wire grid. Provision is made for ultimately mounting suction cups on the bottom wall of the tray for use with a flat surface, and two or more trays can be mounted in side-by-side relationship.

4 Claims, 5 Drawing Sheets

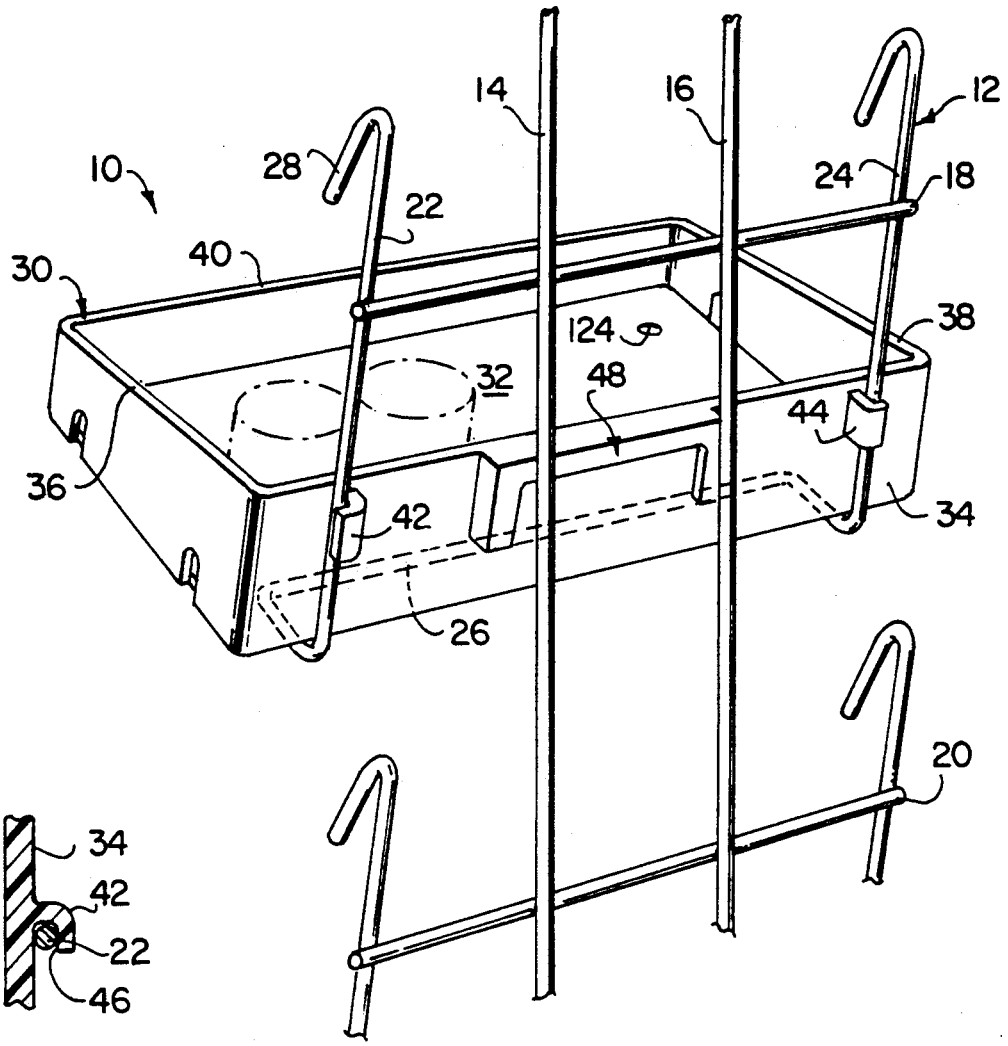
FIG. 2
FIG. 1
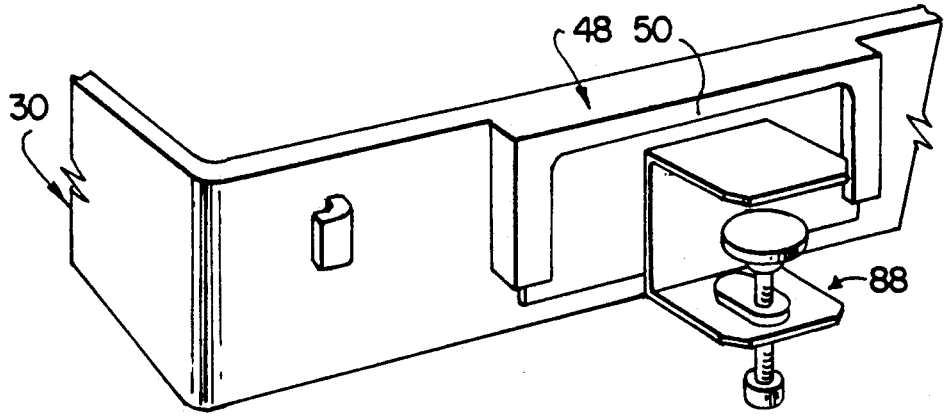
FIG. 10

UNIVERSAL SHELF EXTENDER

BACKGROUND OF THE INVENTION

This invention relates in general to the display of articles and merchandise in supermarkets, stores and other display areas. More particularly, the invention relates to the display of such articles and merchandise on different types of display stands, racks and shelving.

Heretofore display devices known as foil trees have been provided for displaying foil packages in supermarkets and stores. The foil trees are typically constructed of metal rods welded together into a grid-like stand or rack. Individually packaged items can be supported on hooks which form a part of the foil tree. In certain other prior art arrangements, wire baskets containing the merchandise are secured to freestanding display racks. Various other types of wire-formed support arrangements have been provided for displaying specific types of merchandise.

Conventional display arrangements, such as foil trees, are generally suitable for only displaying certain types of merchandise. They are not readily adaptable for displaying a range of merchandise of different sizes and configurations. For example, cans and bottles are not easily suspended from foil trees. The need has been recognized for an arrangement which can be adapted for the display of a range of different types, sizes and configurations of articles and merchandise. Such an arrangement would be more convenient and less costly for the retail store. Different types of merchandise could be displayed together on a single stand or rack, as desired for purposes of aesthetics and product appeal. Such an arrangement would also permit the display stand configuration to be changed so that different products could be featured from time to time.

OBJECTS AND SUMMARY OF THE INVENTION

The present invention relates in general to an improved shelf extender for supporting and displaying articles from a foil tree or other display stand which permits different types of articles and merchandise to be supported on the stand.

Another object is to provide a shelf extender of the type described by which the configuration can be changed for displaying different types of products from time to time.

Another object is to provide a shelf extender of the type described which can be alternately adapted for attachment to a foil tree, to a tag strip, to the edge of a shelf, or to a wire grid.

Another object is to provide a shelf extender of the type described which can further be adapted for mounting on a flat horizontal surface.

In summary, the invention provides a shelf extender comprising a tray having a back wall which is releasably attached to support rods of a foil tree or other display stand without the requirement for separate fasteners. The tray is attached by L-shaped projections which engage support rods of the tree. In other aspects of the invention, means is provided for alternately attaching the tray to a tag mold, or to a wire grid, or to the edge of a flat shelf, or to the top surface of a shelf. The foregoing and additional objects and features of the invention will appear from the following specification in which the several embodiments have been set forth in detail in conjunction with the accompanying drawings.

BRIEF DESCRIPTION OF THE DRAWINGS

FIG. 1 is a perspective view of the universal shelf extender of the invention shown attached to a foil tree.

FIG. 2 is a fragmentary horizontal section view to an enlarged scale of the shelf extender of FIG. 1 showing one of the attachment projections engaged with a support rod of the foil tree.

FIG. 10 is a fragmentary perspective view of a shelf extender according to another embodiment of the invention which is adapted for attachment to the edge of a shelf.

DETAILED DESCRIPTION OF THE PREFERRED EMBODIMENTS

Figure 3:
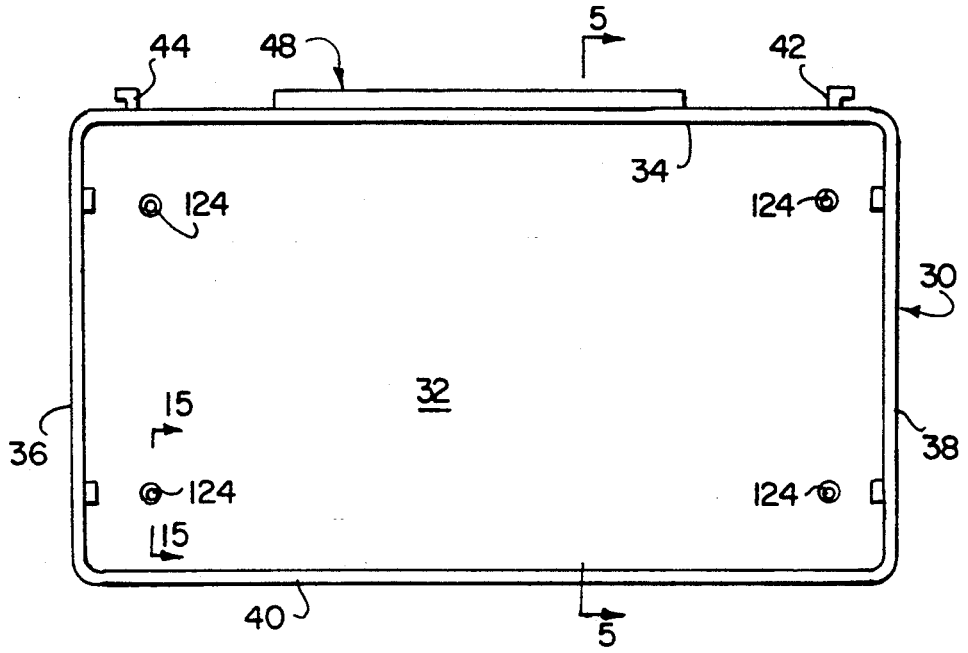
FIG. 3 is a top plan view of the shelf extender of FIG. 1.

In the drawings, FIGS. 1–5 illustrate an embodiment of the invention providing a universal shelf extender 10 which is adapted for attachment to a foil tree 12*a*, display stand of the type which is constructed of a grid of wire rods, or to other shelving. In the typical foil tree 12 shown in FIG. 1, two or more metal rods 14, 16 extend vertically upwardly from a base, not shown, and a plurality of transverse rods 18, 20 are welded to the main rods. Suspended from the transverse rods are a pair of laterally spaced-apart vertically extending support rods 22, 24, the lower ends of which are joined by a rod portion 26 which is bent forwardly to provide a support ledge. The upper ends 28 of the support rods are bent downwardly. The type of foil tree illustrated in FIG. 1 is commonly found in retail stores for supporting boxes that contain foil packages holding perishable foods.

Shelf extender 10 is comprised of a tray 30 formed with a bottom wall 32, an upstanding back wall 34, a pair of side walls 36, 38 and a front wall 40. The walls of the shelf extender can advantageously be molded as an integral unit from a synthetic plastic using conventional molding techniques.

Attachment means for releasably attaching the tray to the support rods of the foil tree is provided and comprises a pair of projections 42, 44 integrally molded on the back wall. The projections are laterally spaced-apart a distance which is commensurate with the lateral spacing of support rods 22, 24. Each projection is molded in the shape of an elongate L-shaped rail which is formed with means that provides a seat for releasably holding a respective one of the support rods when the tray is in its horizontal position. The seat comprises a vertical groove 46, best shown in FIG. 2 for the rail 42, which opens in a direction laterally outwardly from the tray. The width of each groove is commensurate with the outer diameter of the support rods so that there is a tight friction fit between the groove surfaces and the rod.

The configuration and sizing of the projections or rails in relation to the support rods permits the tray to be manually engaged with or disengaged from the foil tree, as desired by the particular display requirements. For attaching the tray, the back wall of the tray is tilted to one side about a horizontal axis so that the rails can be inserted between the support rods. As the next attachment step, the tray is then tilted back toward its horizontal position, bringing the grooves of the rails into engagement with the rods. The tray can then be pushed down so that its bottom wall rests against the forwardly projection rod portion 26 which provides support beneath the tray. The tray is disengaged from the foil tree by a reversal of these steps. The tray is first tilted to one side away from the horizontal position, which disengages the rails from the support rods. The tray can then be pulled forwardly and away from the foil tree.

Figure 6:
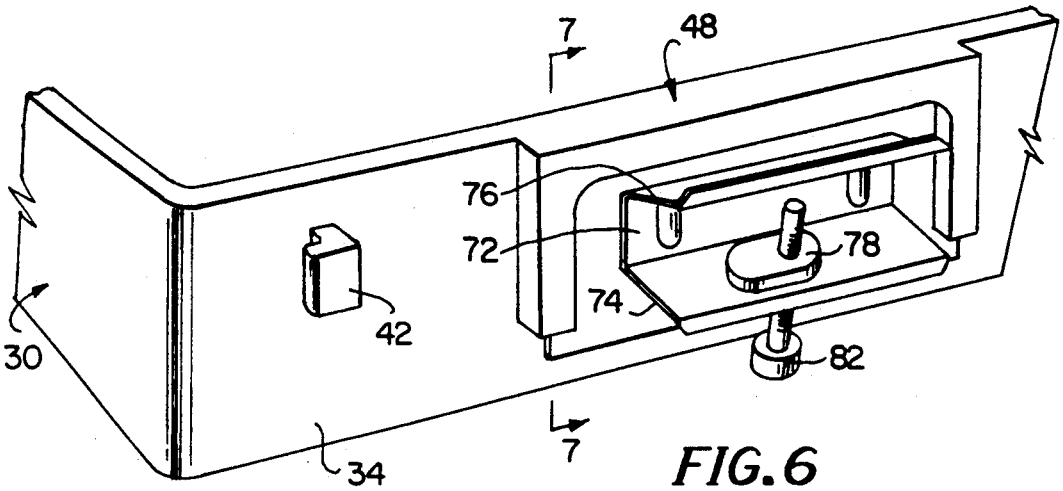
FIG. 6 is a fragmentary perspective view of a shelf extender according to another embodiment of the invention for attachment to a tag mold.
Figure 9:
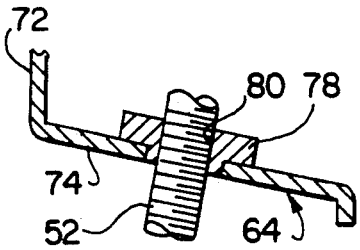
FIG. 9 is a fragmentary sectional view, to an enlarged scale, showing the arrangement for attaching an operating screw to the C-shaped clamp which is a part of the shelf extender of FIG. 7.
Figure 7:
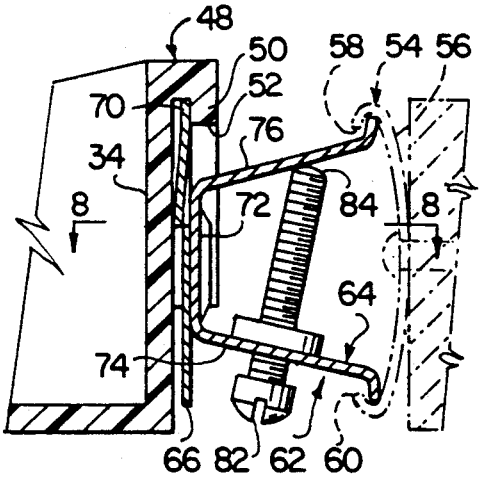
FIG. 7 is a cross-sectional view taken along the line 7—7 of FIG. 6.
Figure 8:
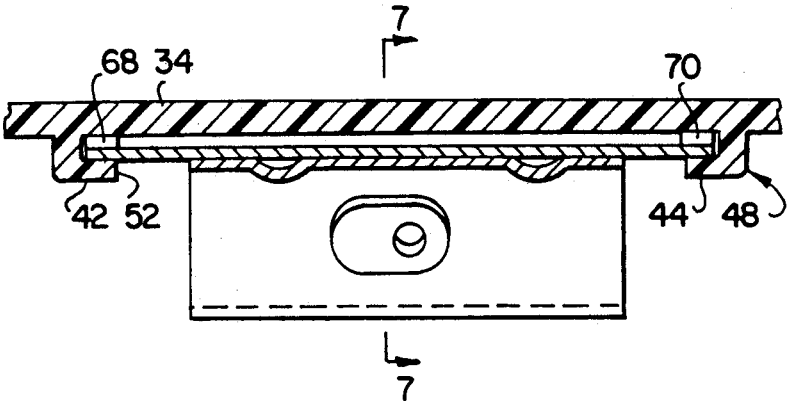
FIG. 8 is a cross-sectional view taken along the line 8—8 of FIG. 7.

Centered on the rear of the tray back wall is a downwardly open support pocket 48 which is adapted for use with the different attachment means of FIGS. 5–13. The pocket is molded with a C-shaped ledge 50 (FIG. 10) which extends around three sides of the perimeter of the cavity. The ledge has an L-shaped cross section, as best shown in FIG. 8. The intrusive rim 52 of the ledge forms one side wall of the cavity, while the opposing portion of the tray back wall 34 forms the other side.

FIGS. 6–8 illustrate one additional attachment means adapted for releasably attaching the tray to a conventional tag mold 54. The tag mold is of the type which comprises a horizontal elongated C-shaped strip 56 having upper and lower parallel, inwardly curved edges 58, 60. Conventionally these tag molds are used to hold paper or plastic strips carrying product names, price information and the like. In this embodiment the additional attachment means includes a bracket 62 which is fitted in support pocket 48. Bracket 62 is comprised of a C-shaped metal clamp 64 which is secured as by spot welding to a flat metal plate 66. Plate 66 is of a rectangular size and shape commensurate with the pocket. This permits the plate to be inserted into and removed from the pocket. On opposite sides of the plate small flexible tabs 68, 70 are bent out a sufficient distance so that they engage in a friction fit with the wall of the cavity when the plate is inserted. The spring resiliency of the tabs releasably retains the plate within the cavity. Sufficient force can be manually applied to overcome the retaining force of the tabs so that the plate can be withdrawn from the cavity, such as when it is desired to exchange the attachment brackets.

C-shaped clamp 64 comprises a base 72 formed integral with a pair of outwardly diverging arms 74, 76. The distal ends of the arms are curved outwardly. The clamp is made of a metal with a suitable thickness which permits the arms to flex toward and away from each other. On one arm 74 a weldnut 78 is attached, and threaded opening 80 (FIG. 9) is formed through the weldnut and underlying arm. An adjusting screw 82 formed with machine threads is mounted through the weldnut, with the screw distal end 84 extending into engagement with the upper arm so that a force can be applied to flex the arms apart. When the arms are not flexed, the distal ends of the arms clear the inwardly curved edges of tag mold strip 56, which permits the bracket arms to be inserted. Using a screw driver or other suitable tool, the screw 82 is turned so that it advances through the weldnut. The force applied by the end of the screw flexes the bracket arms apart so that their distal ends are moved into engagement behind the tag mold edges. With plate 72 mounted in pocket 48, the tray is thereby mounted on the tag mold. The tray can be easily dismounted by turning the screw in a reverse direction so that the arms return to their original positions permitting the bracket to be withdrawn from engagement with the tag mold strip.

Figure 11:
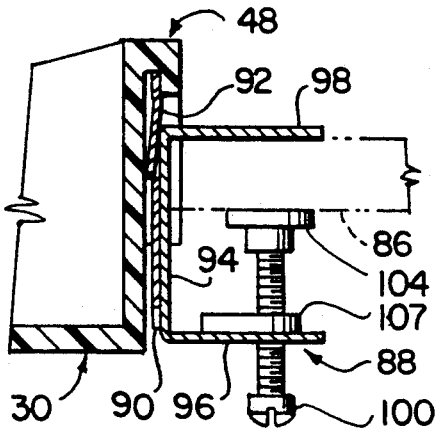
FIG. 11 is a fragmentary cross-sectional view, to an enlarged scale, of components of the shelf extender of FIG. 10.

FIGS. 10 and 11 illustrate another additional attachment means which is adapted to releasably attach tray 30 to the edge of a flat shelf 86. The attachment means of this embodiment comprises the support pocket 48 of the tray in combination with a bracket 88. The bracket includes a flat plate 90 formed with a pair of flexible tabs 92 in the manner explained for the embodiment of FIGS. 6–9. The base of a C-shaped clamp 94 is secured as by welding to plate 90. The clamp has a pair of arms 96, 98 which extend rearwardly and are spaced apart a distance sufficient to span across the vertical thickness of the shelf, as best shown in FIG. 11. Means is provided for moving the arms into and out of engagement with the shelf and comprises a screw 100 having machine threads mounted through a weldnut 102 secured to the lower arm. A flat pad 104 is mounted to freely rotate on the distal end of the screw for bearing against the lower end of the shelf. With the screw retracted, the tray is mounted on the shelf by sliding it onto the upper end of the top shelf edge. The screw is then turned so that the pad is advanced upwardly to lock with the shelf in the manner of a vise. The shelf can be easily dismounted by turning the screw out and then re-attaching the clamp either to another portion of the same shelf or to the edge of a different shelf.

Figure 12:
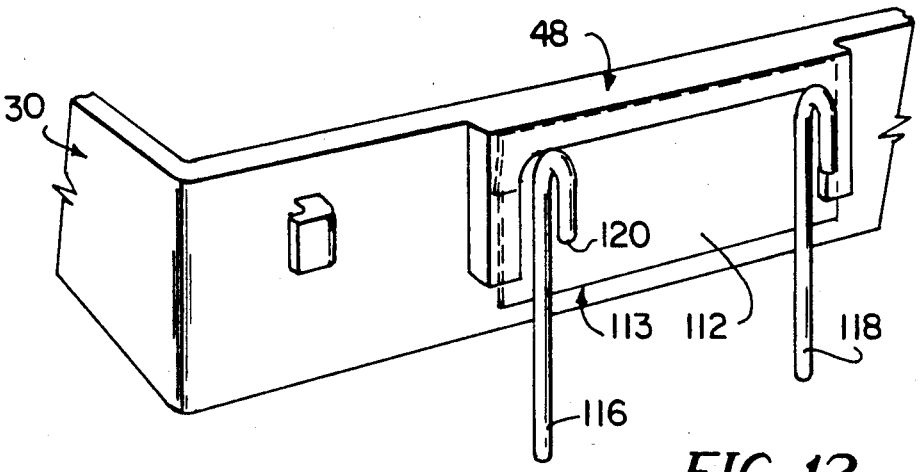
FIG. 12 is a fragmentary perspective view, to an enlarged scale, of a shelf extender according to another embodiment of the invention which is adapted for attachment to a wire grid.
Figure 13:
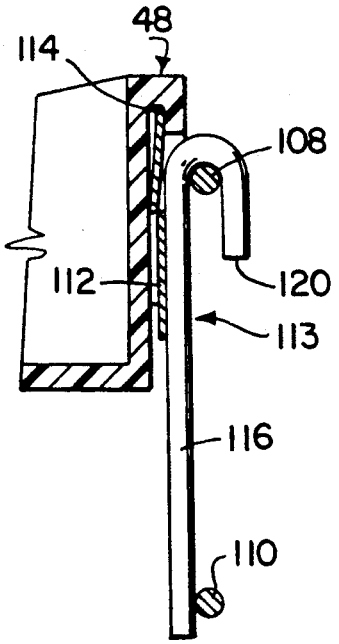
FIG. 13 is a fragmentary cross-sectional view, to an enlarged scale, of components of the shelf extender of FIG. 12.

FIGS. 12–13 illustrate an embodiment providing further additional means for releasably attaching the tray 30 to a wire grid of the type having horizontally elongate wire supports 108, 110. The attachment means is comprised of the tray support pocket 48 into which is fitted a bracket 113. The bracket is comprised of a flat plate 112 having a pair of flexible tabs 114 formed in the manner explained for the embodiment of FIGS. 6–9.

Bracket 113 further includes a pair of laterally spaced-apart, vertically extending hooks 116, 118 secured as by welding to the outer side of plate 112. Each hook is formed at its upper end with a hook point 120 curving rearwardly and downwardly for engagement over the top of one of the wire supports 108. The lower ends of the hooks extend downwardly and rest against the side of the lower wire support 110.

With bracket 113 engaged into support pocket 48, the tray is mounted on the wire grid by dropping the hook points 120 over one of the horizontal wire supports. The hook points are free to be shifted to either side on the wire for adjustment of the tray position. The tray can also be easily moved to another rung on the wire grid, as called for by the particular display.

Figure 14:
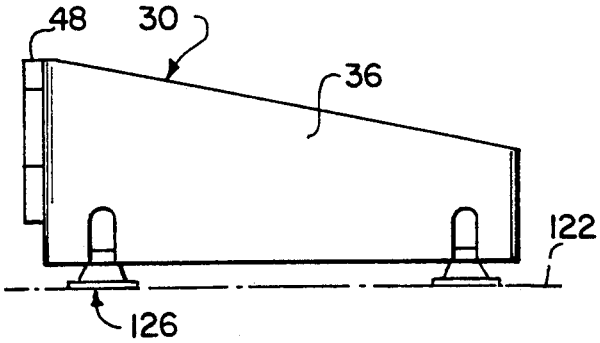
FIG. 14 is a side elevational view of a shelf extender according to another embodiment of the invention adapted for attachment to the top of a shelf.
Figure 15:
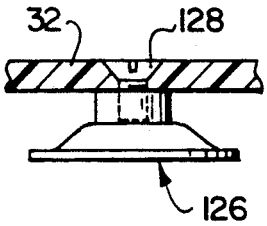
FIG. 15 is a cross-sectional view, to an enlarged scale, illustrating a component element of the shelf extender of FIG. 14.

FIGS. 14 and 15 illustrate means for alternately attaching the tray 30 to the top surface 122 of a shelf. A plurality, preferably four, of holes 124 are drilled near opposite corners of the tray bottom wall 32, as best shown in FIG. 3. Below each hole a suction cup 126 is mounted by means of a threaded fastener 128. The downwardly open suction cups press downwardly against the shelf to firmly hold the tray in place. When the tray is mounted in the other configurations of FIGS. 1–13, the suction cups can be removed for purposes of aesthetics.

Figure 4:
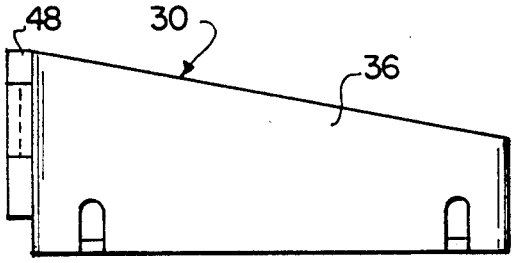
FIG. 4 is a side elevational view of the shelf extender shown in FIG. 3.
Figure 5:
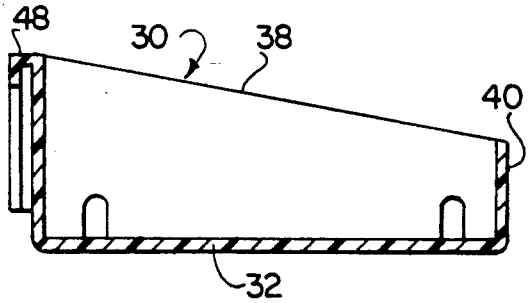
FIG. 5 is a cross-sectional view taken along the line 5—5 of FIG. 3.
Figure 16:
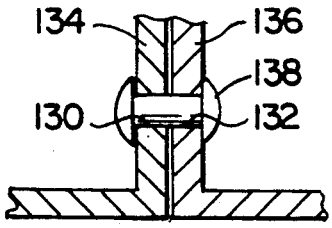
FIG. 16 is a fragmentary cross-sectional view showing the fastener arrangement for attaching a pair of the shelf extenders of the invention in side-by-side relationship.

Two or more of the trays can be secured in side-by-side relationship by the attachment means illustrated in FIG. 16. As best shown in FIGS. 4 and 5, a pair of openings 130, 132 are formed through each side wall 134, 136 of the trays. When a side wall of one tray abuts the side wall of an adjacent tray, the openings are brought into alignment. Suitable fasteners 138 are inserted through the aligned openings for holding the side walls together. The multiple trays attached together in this manner can then be combined with any of the attachment means of FIGS. 1–15 for mounting on foil trees, tag strips, wire grids, shelving or other flat surfaces.

Figure 17:
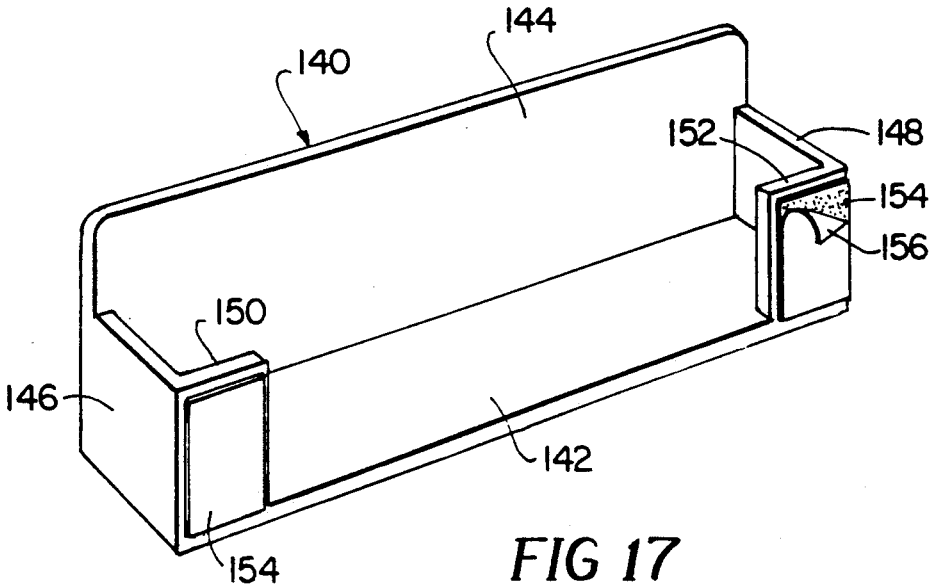
FIG. 17 is perspective view illustrating an embodiment providing a recipe card holder which is attachable to the shelf extender of the invention.
Figure 18:
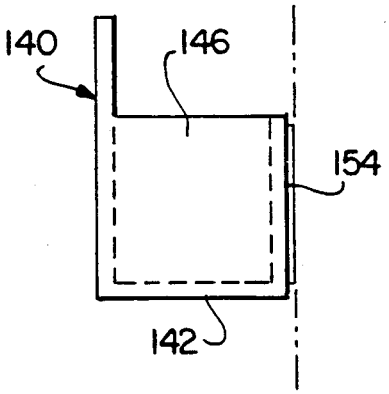
FIG. 18 is a side elevational view of the holder of FIG. 17.

FIGS. 17 and 18 illustrate an upwardly open box 140 which is adapted for releasable attachment to a side wall of any one of the trays of the embodiments of FIGS. 1–16. Box 140 is comprised of a bottom wall 142, a front wall 144 and a pair of side walls 146, 148 from which support walls 150, 152 extend a short distance inwardly. Secured to the outer surfaces of the support walls are strips of double-stick tape 154 having peel-off protective layers 150. With the protective layers removed, the box is mounted by pressing the adhesive surfaces of the tapes against the tray front or side walls. When mounted in this manner the box can hold 5" recipe cards or promotional brochures, for example.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A shelf extender for supporting and displaying articles, the shelf extender comprising the combination of a tray having a bottom wall and an upstanding back wall, first attachment means for selectively attaching the tray to a tag mold or other support structure, said first attachment means comprising a support pocket carried on the outer surface of the back wall and bracket means adapted for fitment in the support pocket for releasably mounting the tray on said tag mold or other support structure, said bracket means including a flat plate which releasably fits in said support pocket, said support pocket having spaced-apart side walls which form an internal cavity for fitment of said flat plate, flexible tab means carried by said plate for projecting outwardly into a friction fit with one of said cavity side walls for lockably retaining the plate within the cavity, and second attachment means for selectively and releasably attaching a tray to a foil tree or other display stand of the type having a plurality of laterally spaced-apart vertically extending support rods, said second attachment means including at least a pair of projections on said back wall of the tray, said projections extending rearwardly from the tray and being laterally spaced apart a predetermined distance which is commensurate with the lateral spacing between said support rods, said second attachment means being tilted between and engaged with the pair of support rods when the back wall of the tray is turned to a substantially horizontal position between the rods, said projections further being tilted away from and disengaged from the support rods when the back wall is turned away from said horizontal position.

2. A shelf extender as in claim 1 in which the projections comprise a pair of vertically elongate rails mounted on and projecting rearwardly from the outer surface of the back wall, said rails being formed with substantially L-shaped cross sections which define grooves sized commensurate with the support rods for friction fitment therein when the projections engage the rods.

3. A shelf extender as in claim 1 in which the tag mold is of the type which comprises a horizontally elongate, C-shaped strip having upper and lower parallel, inwardly curved edges, and said bracket means includes a C-shaped clamp which comprises a base secured to said flat plate and a pair of arms having proximal ends which are carried on and extend generally rearwardly from the base, said arms having distal ends which are spaced vertically apart a predetermined distance sufficient to releasably lock between and behind said inwardly curved edges of the C-shaped strip, and means for selectively moving said distal ends of the arms together and apart for respective disengagement from and engagement with the edges of the C-shaped strip for respective dismounting and mounting of the tray with the tag mold.

4. A shelf extender as in claim 1 in which said internal cavity formed in the support pocket has an opening at its lower end for insertion and removal of the flat plate, and said flexible tab has a distal end which extends generally downwardly toward said opening whereby the tab slides along said one cavity side wall while the plate is being inserted into the cavity and with said distal end of the tab projecting into said friction fit with the cavity side wall for resisting withdrawal of the plate from the cavity.

* * * * *